US007441874B2

(12) United States Patent
Sugahara

(10) Patent No.: US 7,441,874 B2
(45) Date of Patent: Oct. 28, 2008

(54) INSULATED HEAT UNIT FOR INK JET PRINTER, AN INK JET PRINTER INCLUDING AN INSULATED HEAD UNIT AND SIGNAL TRANSMISSION BOARD USED FOR THE INK JET PRINTER

(75) Inventor: Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 478 days.

(21) Appl. No.: 11/086,281

(22) Filed: Mar. 23, 2005

(65) Prior Publication Data

US 2005/0219325 A1 Oct. 6, 2005

(30) Foreign Application Priority Data

Mar. 31, 2004 (JP) ..... 2004-102563

(51) Int. Cl.
*B41J 2/14* (2006.01)
*B41J 2/16* (2006.01)

(52) U.S. Cl. ..... 347/50; 347/68; 347/58

(58) Field of Classification Search ..... 347/20, 347/50, 54, 56–59, 68, 70–72
See application file for complete search history.

(56) References Cited

U.S. PATENT DOCUMENTS 4,695,854 A * 9/1987 Cruz-Uribe ..... 347/70
6,497,477 B1 12/2002 Nakamura et al. ..... 347/70
7,258,423 B2 * 8/2007 Nakamura ..... 347/50

FOREIGN PATENT DOCUMENTS

JP A 2000-351208 12/2000

* cited by examiner

*Primary Examiner*—Juanita D Stephens
(74) *Attorney, Agent, or Firm*—Oliff & Berridge, PLC

(57) ABSTRACT

A head unit has a head main body for discharging ink, a driver IC and an FPC, which is interposed between the driver IC and the head main body. The FPC has through holes each of which is embedded with a conductor. The conductor is bonded to an output terminal of the driver IC and the separate electrode formed on a piezoelectric sheet of the head main body. Thus, the driver IC is connected electrically to the separate electrodes of the head main body. With this arrangement, the heat generated by the driver IC is prevented from propagating to the head.

17 Claims, 10 Drawing Sheets

INSULATED HEAT UNIT FOR INK JET PRINTER, AN INK JET PRINTER INCLUDING AN INSULATED HEAD UNIT AND SIGNAL TRANSMISSION BOARD USED FOR THE INK JET PRINTER

FIELD OF THE INVENTION

The present invention relates to a head unit for an ink jet printer which discharges ink onto a recording medium, an ink jet printer and a signal transmission board used for the same.

BACKGROUND OF THE INVENTION

U.S. Pat. No. 6,497,477 B1 (corresponding to Japanese Patent Application Laid-open No. 2000-351208) describes an ink jet head having a main body with nozzles formed on one side of the head main body. A driver IC is fixed on the other side of the head main body and rides over a plurality of actuators. The driver IC is connected to the actuators and the main body of the printer by wiring. In particular, the driver IC is connected to the actuators by wire bonding. This makes it possible to mount the driver IC without leaving an extra space on the head main body. As a result, the ink jet head as a whole can be small.

However, in the ink-jet head described in U.S. Pat. No. 6,497,477 B1, because the driver IC is fixed directly on one surface of the head main body, heat generated by the driver IC is propagated to the head main body. The heat generated by the driver IC propagates to the head main body, thereby raising the temperature of the ink in the head main body. As a result, the viscosity of the ink becomes low. This prevents ink from being discharged in a constant condition from the head main body. Besides, in terms of costs and operation, wire bonding is disadvantageous to the actuators which have many connections.

SUMMARY OF THE INVENTION

One object of the present invention is to provide an ink jet printer head unit and an ink jet printer in each of which the heat generated by a driver IC can be inhibited from propagating to an ink jet head. Another object of the invention is to provide a signal transmission board for use in or with such a head unit or such an ink jet printer. Still another object of the invention is to provide a head unit and a liquid discharging apparatus such as an ink jet printer each having a simple structure for connecting a liquid discharge head such as an ink jet head and a driver IC effective in heat insulation for the head. A further object of the invention is to provide a signal transmission board for use in or with such a head unit or such a liquid discharging apparatus.

According to a first aspect of the present invention, there is provided a head unit for an ink-jet printer comprising:

an ink jet head having a plurality of nozzles which discharge ink, a plurality of pressure chambers which communicate with the nozzles, respectively, and a discharge pressure applying device which applies ink discharge pressure separately to the respective pressure chambers, wherein electrodes for the pressure applying device are formed on one surface of the ink jet head;

a driver IC which is arranged to face the ink jet head and has output terminals formed on a predetermined surface facing the one surface of the ink jet head;

an insulator which is interposed between the ink jet head and the driver IC and through which through holes are formed; and first signal lines each of which extends through one of the through holes and connects one of the output terminals of the driver IC electrically to one of the electrodes of the pressure applying device.

The interposition of the insulator (insulating member) between the ink jet head and the driver IC prevents easy propagation of the heat generated by the IC to the head. This makes it possible to discharge ink from the ink jet head in a constant state. This also makes it possible to simplify the structure for connecting each output terminal of the driver IC electrically to the associated electrode of the pressure applying device.

In the present invention, the insulator may have a first surface and a second surface, the first and second surfaces facing the driver IC and the ink jet head, respectively, and the head unit may further comprise first terminals which are formed on the first surface of the insulator and each of which is bonded to one of the output terminals of the driver IC, and second terminals which are formed on the second surface of the insulator and each of which is bonded to one of the electrodes of the pressure applying device; wherein each of the first signal lines connects the associated first and second terminals electrically together. Accordingly, the structure for connecting the driver IC to the ink jet head is simplified with the insulator.

The driver IC may further have an input terminal formed on the predetermined surface, the head unit may further comprise a third terminal formed on the first surface of the insulator and bonded to the input terminal of the driver IC, and a second signal line may be formed along an extending direction of the insulator and connected electrically to the third terminal. Accordingly, the insulator can be used in common for the second signal line, through which a signal can be input to the driver IC, and the first signal lines, via which a driving signal is transmitted from the driver IC to the ink jet head, thereby decreasing the cost of the head unit.

The insulator may include a wide part which is interposed between the ink jet head and the driver IC, is larger in outer shape than the driver IC, and formed with the first signal lines and the third terminal; and a narrow part formed with the second signal line. This effectively inhibits propagation of the heat generated by the driver IC.

The wide part may be formed to be smaller in outer shape than the first surface of the ink jet head. Accordingly, the wide part of the insulator becomes smaller to reduce the cost for the insulator.

In the present invention, one opening and the other opening of each of the through holes may be formed in positions different from each other in an extending plane of the insulator. This makes it possible to use an existing driver IC and an existing ink jet head. In this case, there is no need to produce a new driver IC or a new ink jet head so that their electrodes are aligned in the extending plane of the insulator.

The wide part of the insulator may include first regions each of which is disposed in the vicinity of one of the first signal lines; and a second region lower in heat conductivity than the first regions. Accordingly, it is possible to effectively inhibit the heat generated by the driver IC from propagating to the ink jet head.

The insulator may include a first insulating sheet having a surface facing the driver IC; and a second insulating sheet having a surface facing the ink jet head, wherein the first and second insulating sheets are adhered together. This makes it easy to produce an insulator including a region low in heat conductivity.

In the present invention, the insulator may be formed of a resin. Since resin is low in heat conductivity, the heat generated by the driver IC from is hardly propagated to the ink jet head.

According to a second aspect of the present invention, there is provided an ink-jet printer comprising:

an ink jet head having a plurality of nozzles which discharge ink, a plurality of pressure chambers which communicate with the nozzles, respectively, and a discharge pressure applying device which applies ink discharge pressure separately to the respective pressure chambers, wherein electrodes for the pressure applying device are formed on one surface of the ink jet head;

a driver IC having an input terminal and output terminals both of which are formed on a predetermined surface facing the one surface of the ink jet head, wherein a data signal corresponding to an image from the input terminal is inputted to the driver IC and the driver IC outputs a driving signal from one of the output terminals to the pressure applying device; and a signal transmission board which transmits the data signal to the driver IC and which transmits the driving signal outputted from the driver IC to the ink jet head;

wherein the signal transmission board includes a substrate which is formed of a insulating material and is interposed partially between the ink jet head and the driver IC, first signal lines which transmit the driving signal to the ink jet head, and a second signal line which transmits the data signal to the driver IC;

wherein the first signal lines are embedded in through holes which are formed through the substrate, and electrically connect first terminals, each of which is formed on a surface of the substrate facing the driver IC and connected to one of the output terminals of the driver IC, and second terminals each of which is formed on a surface of the substrate facing the ink jet head and is bonded to one of the electrodes of the pressure applying device; and wherein the second signal line is formed along an extending direction of the substrate and is electrically connected to a third terminal which is formed on the surface of the substrate facing the driver IC. The third terminal may be electrically connected to the input terminal of the driver IC.

The signal transmission board can be used as a means for inhibiting propagation of the heat generated by the driver IC. This makes it unnecessary to provide another means for inhibiting the heat propagation. Because the first signal lines extend through the substrate of the signal transmission board, and because the second signal line extends along the signal transmission board, the single transmission board can be used in common for the first and second signal lines, thereby reducing the cost of connecting the driver IC to the ink jet head.

According to a third aspect of the present invention, there is provided a signal transmission board which is used for an ink-jet printer having a plurality of nozzles which discharge ink, a plurality of pressure chambers which communicate with the nozzles, respectively, and a discharge pressure applying device which applies ink discharge pressure separately to the respective pressure chambers, wherein electrodes for the pressure applying device are formed on one surface of the ink jet head; and a driver IC having an input terminal and output terminals both of which are formed on a predetermined surface facing the one surface of the ink jet head, wherein a data signal corresponding to an image from the input terminal is inputted to the driver IC and the driver IC outputs a driving signal from one of the output terminals to the pressure applying device, the signal transmission board comprising:

a substrate which is formed of an insulating material and is interposed partially between the ink jet head and the driver IC;

first signal lines which transmit the driving signal to the ink jet head; and a second signal line which transmits the data signal to the driver IC;

wherein the first signal lines are embedded in through holes formed through the substrate, respectively, and electrically connect first terminals each of which is formed on a surface of the substrate facing the driver IC and bonded to one of the output terminals of the driver IC, and second terminals each of which is formed on a surface of the substrate facing the ink jet head and is bonded to one of the electrodes of the pressure applying device; and wherein the second signal line is formed along an extending direction of the substrate and is electrically connected to a third terminal which is formed on the surface of the substrate facing the driver IC. The third terminal may be connected electrically to the input terminal of the driver IC. The signal transmission board can be used to take measures against the heat radiation from the driver IC. In addition, the cost of the signal transmission board becomes cheap.

In the present invention, one opening and the other opening of each of the through holes may be formed in positions different from each other in an extending plane of the substrate. This makes it possible to use an existing driver IC and an existing ink jet head. In this case, there is no need to so produce a new driver IC or a new ink jet head that their electrodes are aligned in the plane where the substrate extends.

According to a fourth aspect of the present invention, there is provided a head unit for a liquid discharging apparatus, comprising:

a liquid discharging head having a plurality of nozzles which discharge liquid, a plurality of pressure chambers which communicate with the nozzles, respectively, and an actuator which applies liquid discharge pressure separately to the respective pressure chambers;

a driver IC which drives the actuator; and an insulating sheet which includes wiring connected to the driving IC to transmit a data signal to the driver IC through the wiring, wherein the insulating sheet is interposed between the actuator and the driver IC. The insulating sheet prevents the heat transfer from the driver IC to the liquid discharge head and simplifies the electric connection of the IC to the actuator. The head unit may have a first surface and a second surface opposite to the first surface, the nozzles may be formed on the second surface, the head unit may further have electrodes for the actuator which are formed on the first surface of the head unit; and the head unit may further comprise conductors extending through the insulating sheet, wherein each of the conductors connects the driver IC and one of the electrodes for the actuator electrically together. According to the present invention, there is provided a liquid discharging apparatus including the liquid discharging head unit.

DETAILED DESCRIPTION OF PREFERRED EMBODIMENTS

First Embodiment

A first preferred embodiment of the present invention will be described below with reference to the drawings.

Figure 1:
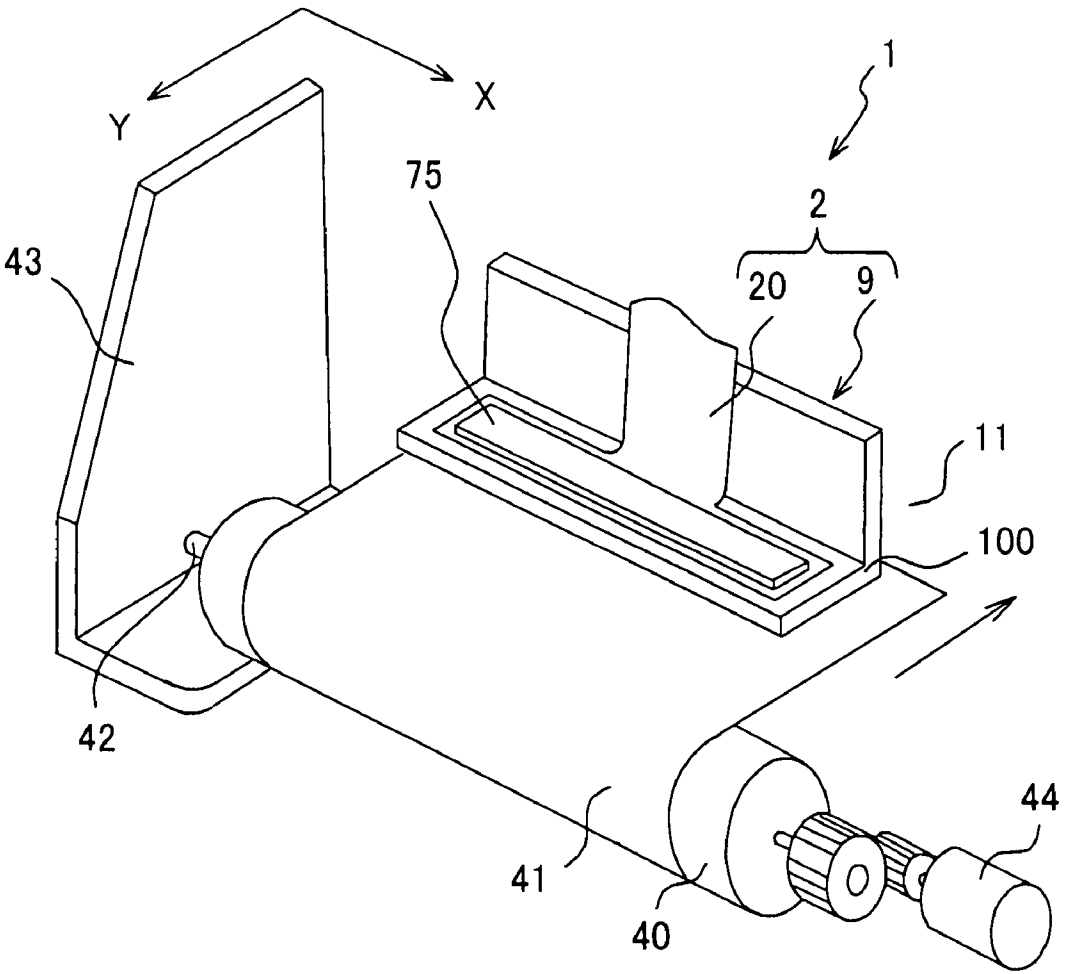
FIG. 1 is a schematic perspective view of an ink jet printer according to a first embodiment of the present invention.

As shown in FIG. 1, an ink jet printer 1 according to the first embodiment includes a platen roller 40 and a head unit 2. The platen roller 40 conveys paper 41 as a recording medium. The head unit 2 includes an ink jet head 9 and a flexible printed circuit (FPC) 20. The ink jet head 9 discharges ink onto paper 41 set on the platen roller 40. The FPC 20 is a signal transmission board via which the ink jet head 9 is supplied with driving voltage (driving signals).

The platen roller 40 is rotatably fixed to a frame 43 with a shaft 42 and is rotated by a motor 44. Paper 41 is fed from a paper cassette (not shown) which is provided near the ink jet printer 1. The platen roller 40 conveys the fed paper 41 at a constant speed in a direction indicated by an arrow in the drawing. While paper 41 is conveyed, the ink jet head 9 discharges ink so as to perform a predetermined printing on the paper 41. Then, the paper 41 is discharged from the ink jet printer 1. FIG. 1 omits a detailed illustration of the paper feeding and discharging mechanisms. The ink jet printer 1 as shown in FIG. 1 is a monochromatic printer, which includes only one head unit 2. For color printing, at least four head units 2 for yellow, magenta, cyan and black would be positioned in parallel.

As shown in FIG. 1, the ink jet head 9 of the head unit 2 is a line head extending perpendicular to the conveying direction in which paper 41 is conveyed. The ink jet head 9 is fixed with respect to the frame 43. The ink jet head 9, which discharges ink onto paper 41, has a head main body 100 and a base part 11. The head main body 100 extends linearly in a direction (direction orthogonal to the conveying direction of the paper). The base part 11 extends perpendicularly to the head main body 100 and supports the head main body 100.

Figure 3:
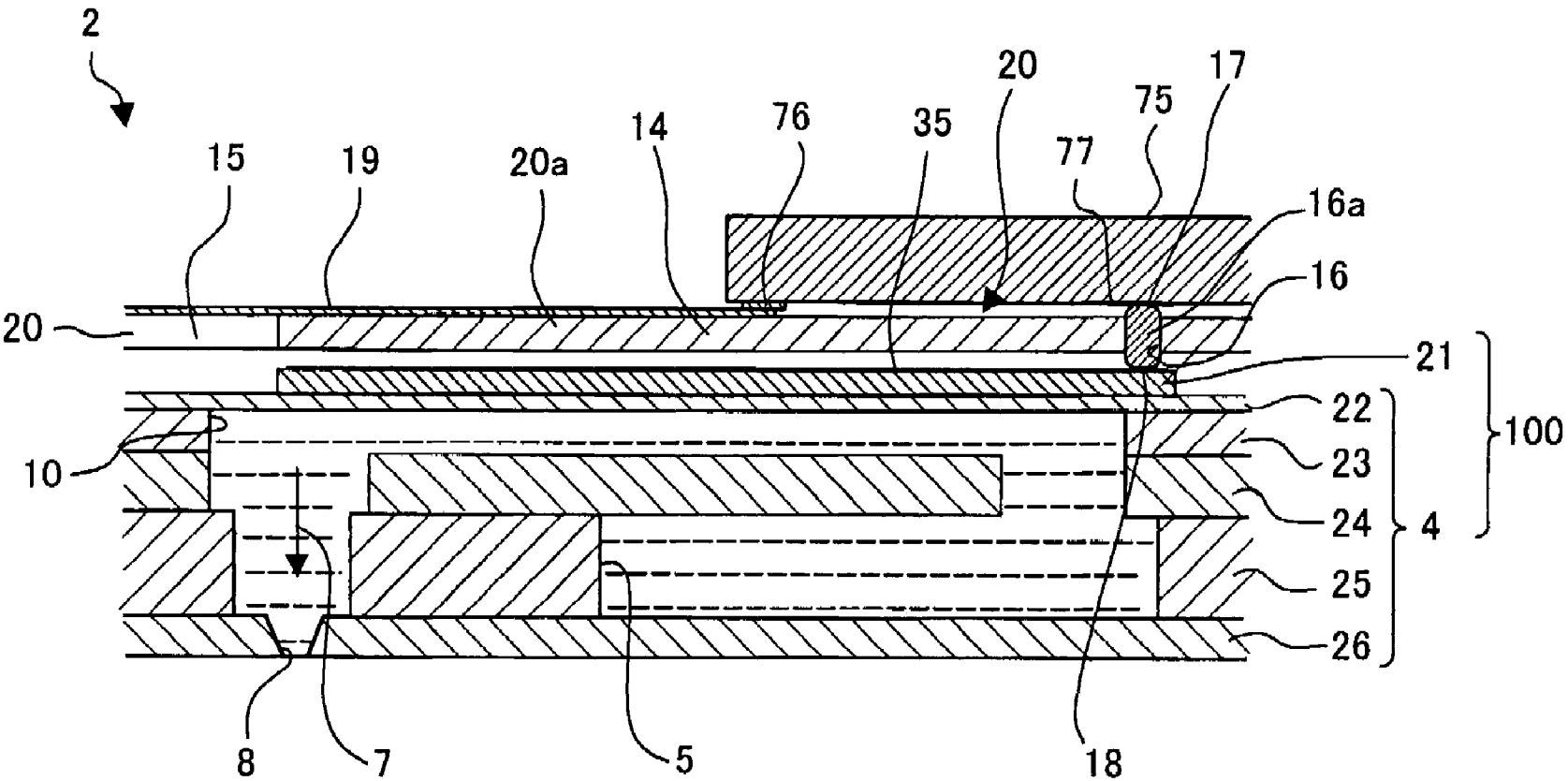
FIG. 3 is an enlarged cross section of the head unit shown in FIG. 1.

With reference to FIG. 3, the ink jet head 9 has a large number of nozzles 8 formed through its bottom which is parallel to the portion of paper 41 that has left the platen roller 40. Ink is discharged through the nozzles 8 in accordance with the data signals from the control unit (not shown) in the ink jet printer 1. The discharged ink flies toward paper 41.

The head unit 2 will be described in more detail below with reference to FIGS. 1 to 3. The head unit 2 includes a driver IC 75 in addition to the ink jet head 9 and FPC 20, which are shown in FIG. 1. The driver IC 75 is arranged over the FPC 20, which is stuck to the top surface of the head main body 100. The FPC 20 extends from the top surface of the head main body 100 upwardly along a side wall of the base part 11 and is connected to the control unit (not shown) in the ink jet printer 1.

Figure 2:
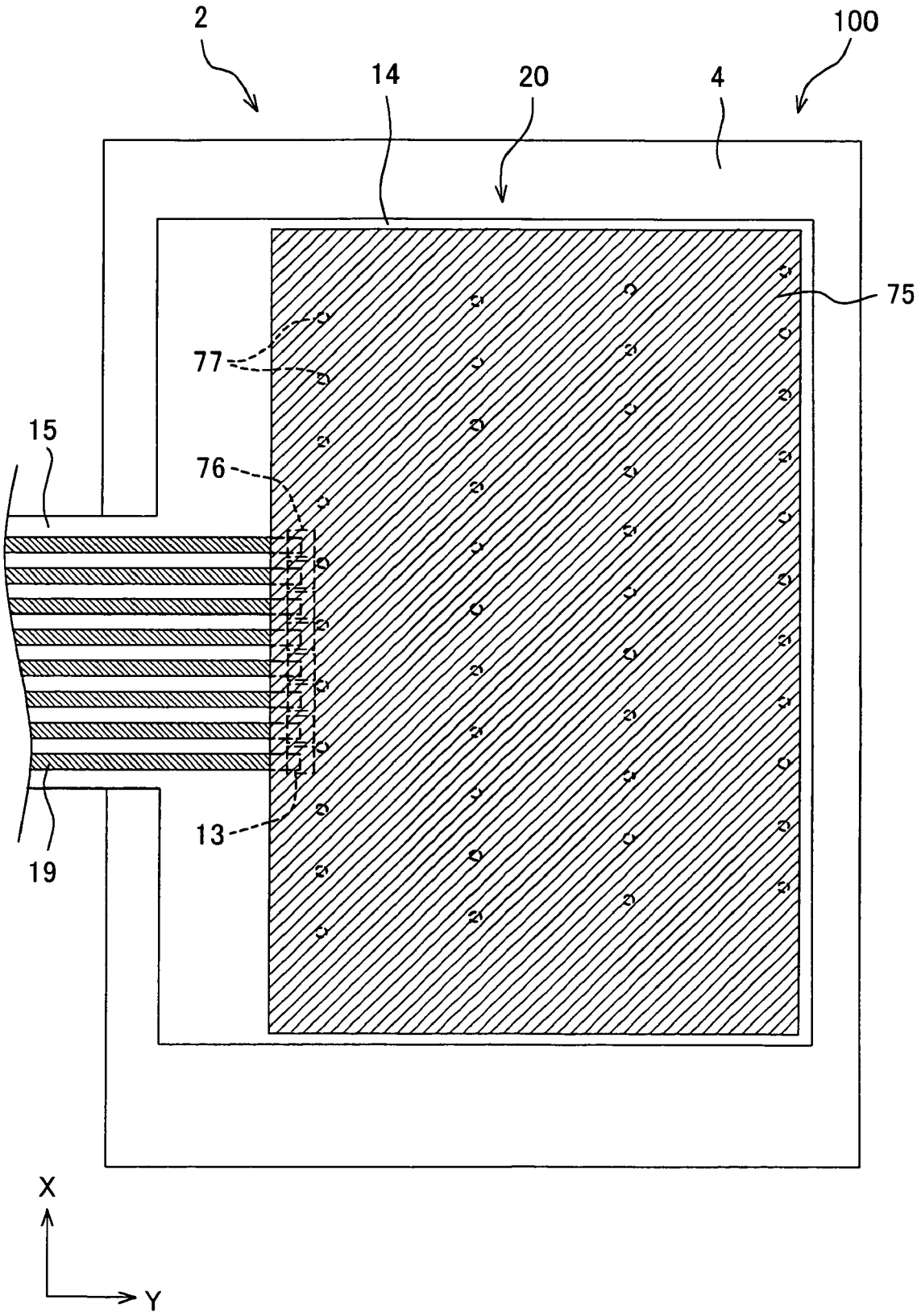
FIG. 2 is an enlarged top plan of the head unit shown in FIG. 1.

As shown in FIG. 2, the FPC 20 includes a wide part 14 and a narrow part 15. The wide part 14 faces the head main body 100 and extends along the same direction X in which the head main body extends. The narrow part 15 extends in a leftward direction in FIG. 2 from the middle of the left edge of the wide Part 14 in FIG. 2, namely in a direction Y perpendicular to the direction X in which the head main body 100 extends. The wide part 14 is rectangular in plan view and similar in shape to the top surface of the head main body 100, but is formed to be smaller than the head main body 100. In this embodiment, the width of the narrow part 15 that is perpendicular to the direction Y, in which the narrow part 15 extends, is about ⅓ of the width of the wide part 14 in the direction X, in which the wide part 14 extends.

As shown in FIG. 2, the driver IC 75 is arranged over the wide Part 14. In other words, the wide Part 14 is interposed between the driver IC 75 and head main body 100. The driver IC 75 is rectangular in plan view and smaller in plan view than the wide Part 14. As shown in FIG. 3, the driver IC 75 has a plurality of input terminals 76 and a plurality of output terminals 77 all formed on the bottom surface of the driver IC 75 which faces the top surface of the FPC 20. The data signals from the control unit is inputted via the input terminals 76 into the driver IC 75, and the driver IC 75 outputs driving signals via the output terminals 77 to piezoelectric sheets 21. The head main body 100 has a plurality of pressure chambers 10 formed therein. Each of the piezoelectric sheets 21 is provided for one of the pressure chambers 10 and constitutes a discharge pressure applying device or means for applying discharge pressure on the ink in the pressure chambers 10. These will be described later on in detail. The plurality of input terminals 76 are arranged in the middle portion in the left side of the driver IC 75 in FIG. 2 in the direction X in which the head main body 100 extends. Each input terminal 76 is bonded to a terminal 13, which will be described later on, formed on the FPC 20. The plurality of output terminals 77 are arranged in four parallel rows in the direction X. The output terminals 77 in each row are spaced at approximately regular intervals. Each output terminal 77 is bonded to a separate electrode 35 via a conductor **16*a*, which extends through the FPC 20. The separate electrode 35 and conductor 16*a*** will be described later on.

The FPC 20 will be described in more detail below with reference to FIGS. 3 and 4. The FPC 20 includes a substrate in the form of a sheet and conductors **16*a* and 19, which will be described later on. In this embodiment, the FPC sheet member is flexible and made of polyimide resin, but may be made of other insulating materials such as rubber, resin or ceramics. The wide Part 14 of the FPC 20 has a plurality of through holes 16 cut through in the thickness direction of the FPC 20 within an area 75*a* over which the driver IC 75 is disposed, and which is indicated by the two-dot chain lines in FIG. 4. As shown in FIG. 3, each through hole 16 is positioned under one of the output terminals 77 of the driver IC 75. Each conductor (a first signal line) 16*a* extends through one of the through holes 16 and protrudes from the top and bottom surfaces of the FPC 20. The portion of each conductor 16*a* protruding from the upper surface of the FPC 20 is a terminal portion (first terminal) 17, which is bonded to the associated output terminal 77 of the driver IC 75. The portion of each conductor 16*a* protruding from the lower surface of the FPC 20 is a terminal portion (second terminal) 18, which is bonded to the associated separate electrode 35**.

Figure 4:
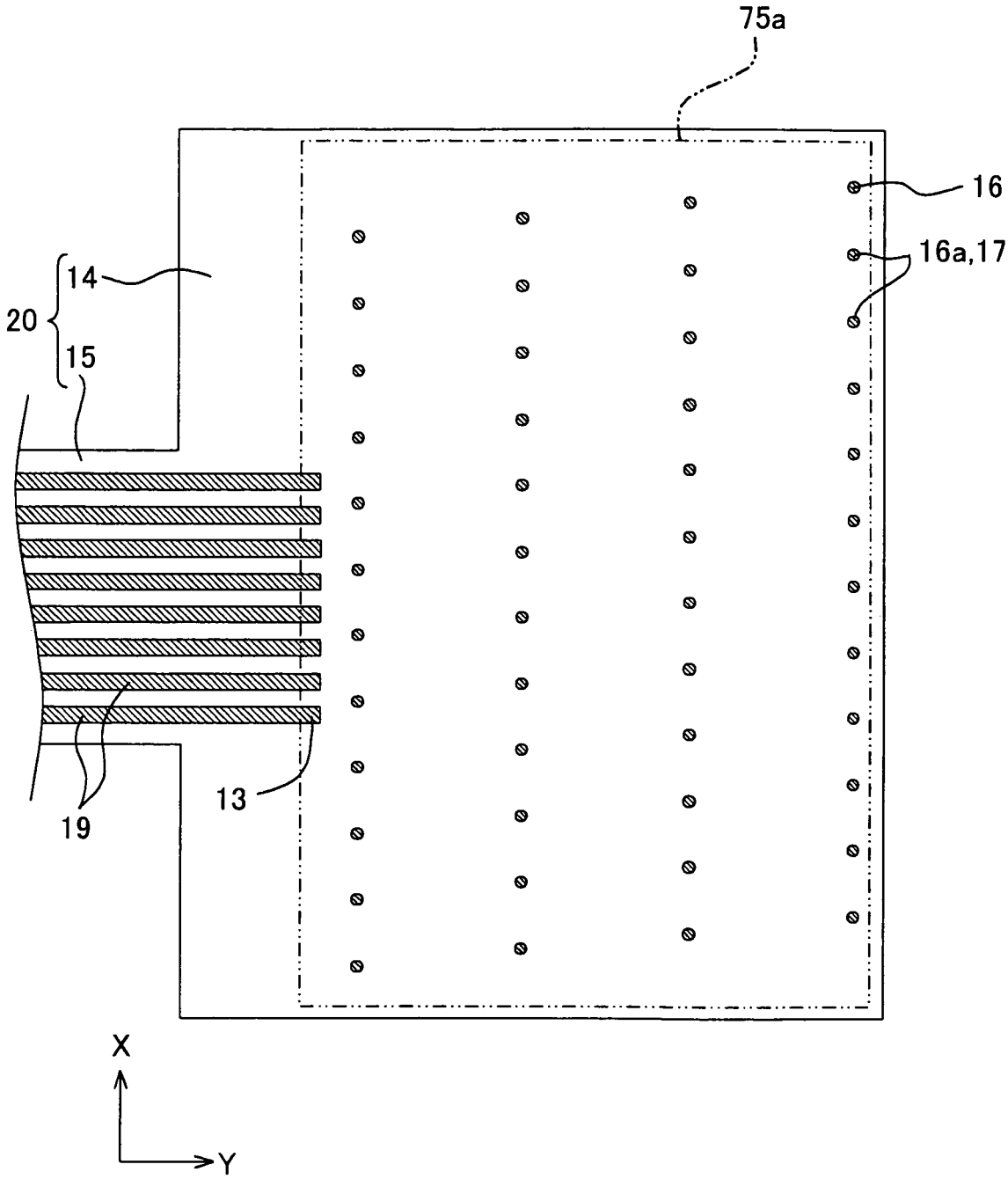
FIG. 4 is a top plan of the FPC (flexible printed circuit) shown in FIG. 2.

A plurality of conductors (second signal lines) 19 are formed on the upper surface of the FPC 20 and extend in parallel with each other from the left side of the wide part 14 in FIG. 4 in the direction Y in which the narrow part 15 extends. As shown in FIG. 2, the end of each conductor 19 that is positioned on the wide Part 14 is a terminal portion (third terminal) 13, which is positioned under one of the input terminals 76 of the driver IC 75. The other end of each conductor 19 is formed in a position where the other end can be connected to the control unit (not shown). In other words, each conductor 19 extends between the associated input terminal 76 and the control unit, and electrically connects the driver IC 75 and the control unit. As shown in FIG. 3, the driver IC 75 is arranged over the FPC 20. Each input terminal 76 is bonded to the terminal 13 of the associated conductor 19. Each output terminal 77 is bonded to the terminal 17 of the associated conductor 16*a*. The terminal 18 of each conductor 16*a* is bonded to the associated separate electrode 35. This enables the driver IC 75 to apply driving voltage to the piezoelectric sheets 21 according to the data signals from the control unit.

The head main body 100 will be described in more detail below with reference to FIG. 5. The head main body 100 includes a channel unit 4 and a plurality of piezoelectric sheets 21 which are formed on the top surface of the channel unit 4. The channel unit 4 is rectangular in plan view and extends in the same direction as the head main body 100 extends. The channel unit 4 has a manifold formed therein and having four parallel branches 5, which extend parallel to one another and in a longitudinal direction of the channel unit 4 and communicate with one another at both their ends (not shown). The plurality of piezoelectric sheets 21 are roughly rectangular in plan view, and have rounded corners. The piezoelectric sheets 21 are formed under the wide part 14 and arranged in four parallel rows, each of which extends along one of the manifold branches 5. In other words, the wide part 14 of the FPC 20 is arranged so as to ride over the plurality of piezoelectric sheets 21. The piezoelectric sheets 21 in each row are spaced at approximately regular intervals in the extending direction of the channel unit 4.

Figure 5:
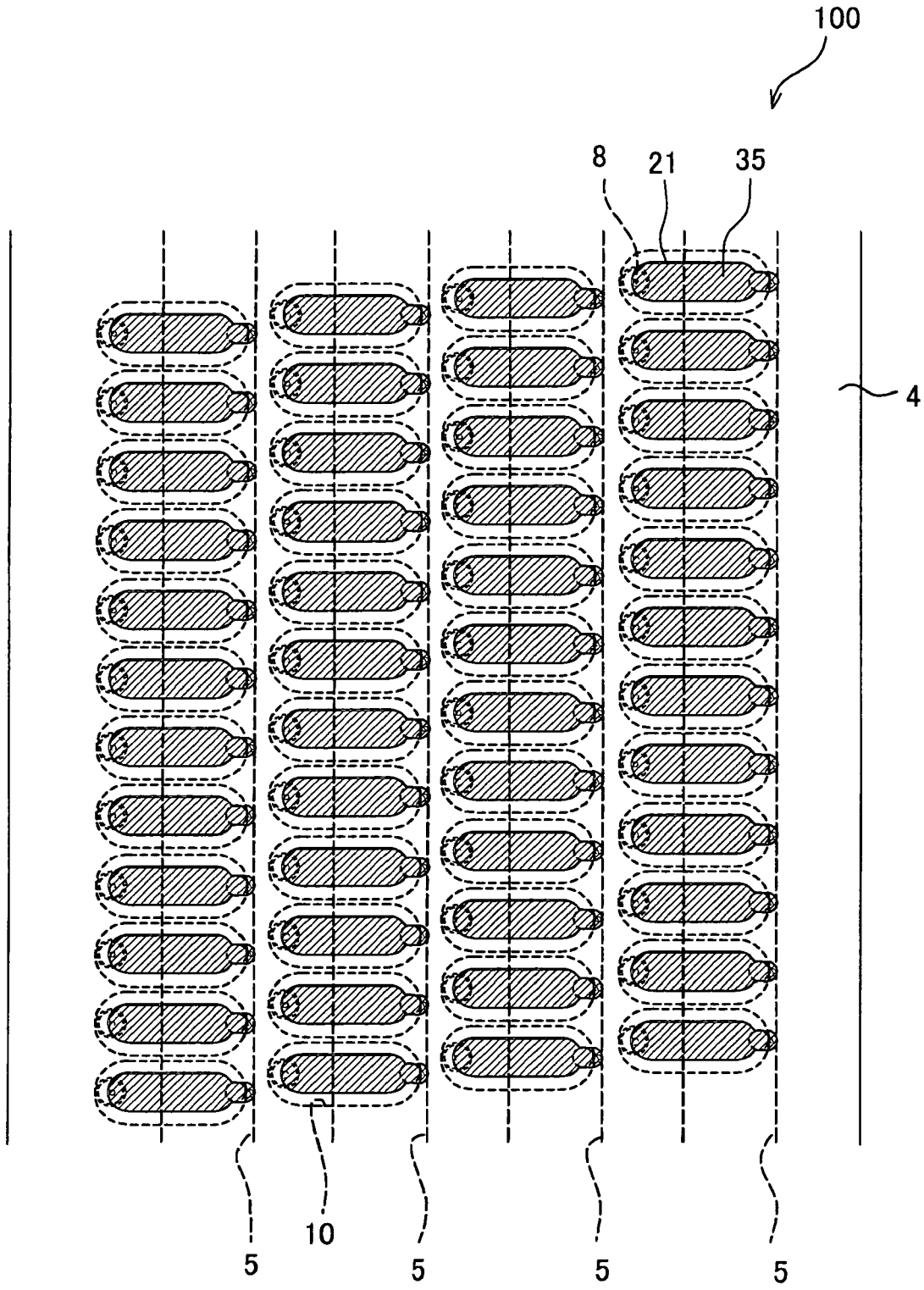
FIG. 5 is an enlarged top plan of the head main body shown in FIG. 1.

As shown in FIG. 5, the plurality of pressure chambers 10 are formed in the channel unit 4 and roughly rectangular in plan view. The corners of the pressure chambers 10 are round. The pressure chambers 10 are similar in plan view to the piezoelectric sheets 21. The major portion of each piezoelectric sheet 21 is arranged so as to accommodate in a plane area of the associated chamber 10. One end of each pressure chamber 10 communicates with one of the nozzles 8, and the other end communicates with the adjacent manifold branch 5.

As shown in FIG. 3, each nozzle 8 communicates with the associated manifold branch 5 via the associated pressure chamber 10. Specifically, each manifold branch 5 has a plurality of outlets. The head main body 100 has discrete ink channels 7 formed therein each for one of the pressure chambers 10. Each discrete ink channel 7 extends from one of the outlets of the associated manifold branch 5 through the associated pressure chamber 10 to the associated nozzle 8.

As shown in FIG. 3, the head main body 100 has a laminated structure consisting of six sheets which are the piezoelectric sheets 21, an actuator plate 22, a cavity plate 23, a supply plate 24, a manifold plate 25 and a nozzle plate 26 laminated in this order from the top. The five plates 22 to 26 form the channel unit 4.

As described later on in detail, a separate electrode 35 is formed on each piezoelectric sheet 21. Application of driving voltage to each separate electrode 35 displaces the associated piezoelectric sheet 21. The piezoelectric sheets 21, separate electrodes 35 and actuator plate 22 form a discharge pressure applying device or means, which applies pressure on the ink in the channel unit 4 to discharge ink through the nozzle 8. The actuator plate 22 functions as a common electrode.

The five plates 22 to 26 are metallic. The actuator plate 22 covers a plurality of holes which are formed through the cavity plate 23 to constitute the pressure chambers 10, each of which is disposed in a position corresponding to the associated piezoelectric sheet 21. The supply plate 24 has inlet and outlet holes cut therethrough. The manifolds 5 are holes cut through the manifold plate 25, which has outlet holes cut therethrough. Each pressure chamber 10 communicates with the associated manifold 5 via one of the inlet holes of the supply plate 24. Each pressure chamber 10 also communicates with the associated nozzle 8 via one of the outlet holes of the supply plate 24 and one of the outlet holes of the manifold plate 25. The nozzle plate 26 is a metallic plate formed with the nozzles 8 therethrough, each of the nozzles 8 being provided for the associated pressure chamber 10 of the cavity plate 23.

The five plates 22 to 26 are so aligned that discrete ink channels 7 as shown in FIG. 3 are formed. The aligned plates 22 to 26 are laminated. Each ink channel 7 extends upwardly from the associated manifold branch 5, horizontally through the associated pressure chamber 10 and downwardly to the associated nozzle 8.

The major portion of each piezoelectric sheet 21, except for a right end portion thereof in FIG. 3, faces the associated pressure chamber 10. As shown in FIG. 5, each separate electrode 35 covers the major portion of the top surface of the associated piezoelectric sheet 21. The separate electrodes 35 are separated from one another. As shown in FIG. 3, the terminal 18 of each conductor 16*a* of the FPC 20 is bonded to the portion of the associated separate electrode 35 at a position where the electrode 35 faces a partitioning wall of the cavity plate 23 in which a hole constituting the pressure chamber 10 is formed but does not face the pressure chamber 23. A large number of the piezoelectric sheets 21 and separate electrodes 35 can be arrayed densely on the actuator plate 22 by screen printing. This makes it possible to densely array the pressure chambers 10 as well, which are formed substantially under the respective separate electrodes 35. This, in turn, enables high resolution image printing.

In this embodiment, the piezoelectric sheets 21 are made of lead zirconate titanate (PZT) or other ferroelectric ceramic material. The separate electrodes 35 are made of Ag—Pd or other metallic material, and each of the electrodes 35 is connected electrically to the terminal 18 of the associated independent conductor 16*a* of the FPC 20. This enables the control unit to control the potential for each pressure chamber 10 via the conductors 19 of the FPC 20, the driver IC 75 and the associated conductor 16*a* of the FPC. The potential of the actuator plate 22 is maintained at the ground potential, and the actuator plate 22 functions as the common electrode.

A method for driving the piezoelectric sheets 21 will be described below. The piezoelectric sheets 21 are polarized across their thickness. Accordingly, when potential higher than the ground potential is applied to each separate electrode 35, an electric field is applied to a portion of the associated sheet 21 in the direction of polarization. This sheet portion acts as an active layer, which tends to expand up and down and contract transversely due to a piezoelectric transverse effect. Due to this phenomena, the piezoelectric sheet 21 and the actuator plate 22 deform to project toward the pressure chamber 10 (unimorph deformation). At this time, as shown in FIG. 3, the lower surface of the actuator plate 22 is fixed to the upper surface of the partitioning wall (cavity plate) 23 which partitions the pressure chambers 10. As a result, the piezoelectric sheet 21 and the actuator plate 22 deform to project toward the pressure chamber 10. Consequently, the volume of the pressure chamber 10 decreases, so that the pressure of the ink therein increases. As a result, ink is discharged from the pressure chamber 10 through the associated nozzle 8. Subsequently, when the potential of the separate electrode 35 is switched back to that of the actuator plate 22, which acts as the common electrode, the piezoelectric sheet 21 and actuator plate 22 return to their original shapes. This restores the pressure chamber 10 to its original volume, thereby sucking ink thereinto from the associated manifold branch 5.

Another method for driving the piezoelectric sheets 21 will be described below. In advance, the potential of the separate electrodes 35 is maintained at a value different from the potential of the actuator plate 22, which acts as the common electrode. In accordance with each discharge request, the potential of the appropriate electrode 35 is equalized once to that of the actuator plate 22. At a predetermined subsequent timing, the potential of the separate electrode 35 is switched back to the different potential from that of the actuator plate 22. In this case, when the potentials of the separate electrode 35 and actuator plate 22 are equal, the piezoelectric sheet 21 and actuator plate 22 return to their original shapes. This increases the volume of the associated pressure chamber 10 in comparison with its initial volume, thereby sucking ink thereinto from the associated manifold branch 5. Subsequently, the separate electrode 35 is applied with a potential again at a timing different from the timing when the actuator plate 22 is applied with the potential. As a result, the piezoelectric sheet 21 and actuator plate 22 deform downwardly toward the pressure chamber 10, thereby reducing the volume of the pressure chamber 10. This increases the ink pressure in the pressure chamber 10, thereby discharging ink through the associated nozzle 8. In this way, a desired image is printed on the paper 41 being conveyed.

As described above, the FPC 20 holding the conductors (first signal lines) 16*a* is interposed between the main body 100 of the ink jet head 9 and the driver IC 75. This prevents the heat generated by the driver IC 75 from propagating to the head main body 100. In other words, it is possible to shut off or block the heat radiation from the driver IC 75 without providing a dedicated heat-shielding member. The conductors 16*a* of the FPC 20 have terminals 17 and 18. This makes it possible to connect the output terminals 77 of the driver IC 75 electrically to the respective separate electrodes 35 with simple connecting structures. The conductors 19 of the FPC 20 are connected electrically to the respective input terminals 76 of the driver IC 75. This makes it possible to transmit the data signals from the control unit to the driver IC 75 through the single FPC 20. This also makes it possible to supply the driving voltage from the driver IC 75 to the separate electrodes 35 through the respective conductors 16*a*. In other words, because two types of conductors 16*a* and 19 are formed on the common FPC 20, there is no need to form the two types of conductors on different FPCs. This reduces the cost of producing the head unit 2, consequently reducing the cost of producing the ink jet printer.

Because the driver IC 75 is positioned to be accommodated within the wide part 14, which is larger than the driver IC 75 in plan view, it is possible to effectively inhibit the heat generated by the driver IC 75 from propagating to the head main body 100. Because the wide part 14 is smaller than the top surface of the head main body 100, it is possible to reduce the cost incurred for the FPC 20. Because the FPC 20 is made of polyimide resin, which is low in heat conductivity, it is possible to prevent the heat generated by the driver IC 75 from propagating easily to the head main body 100.

Because the head unit 2 including such an FPC 20 (signal transmission board) is fitted or provided in the ink jet printer 1, there is no need to provide in the printer another means for inhibiting the propagation of heat generated by the driver IC 75. In other words, the FPC 20 also serves as a shield against the heat radiation from the driver IC 75.

Second Embodiment

Figure 6:
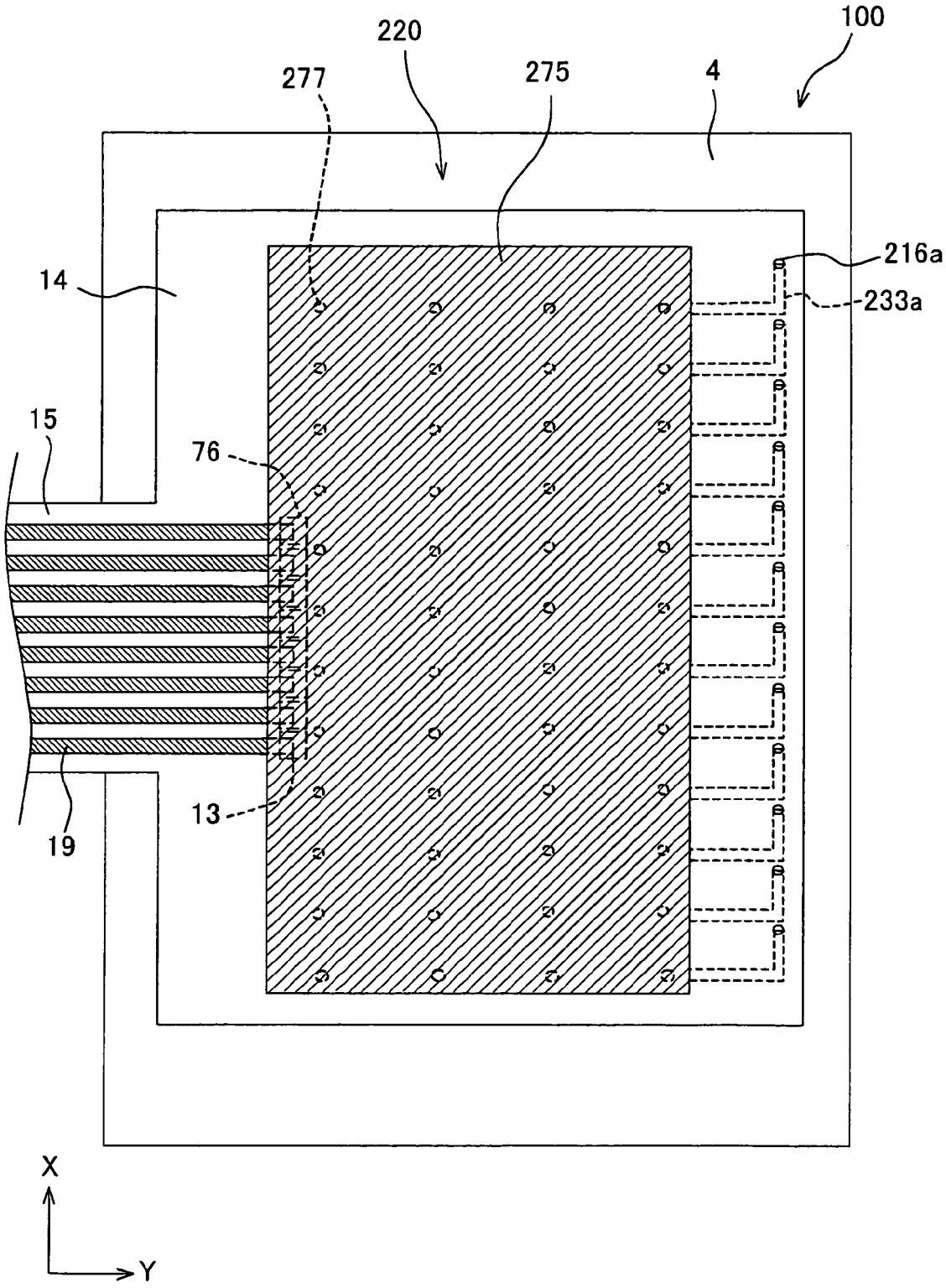
FIG. 6 is an enlarged top plan of a head unit according to a second embodiment of the present invention.
Figure 7:
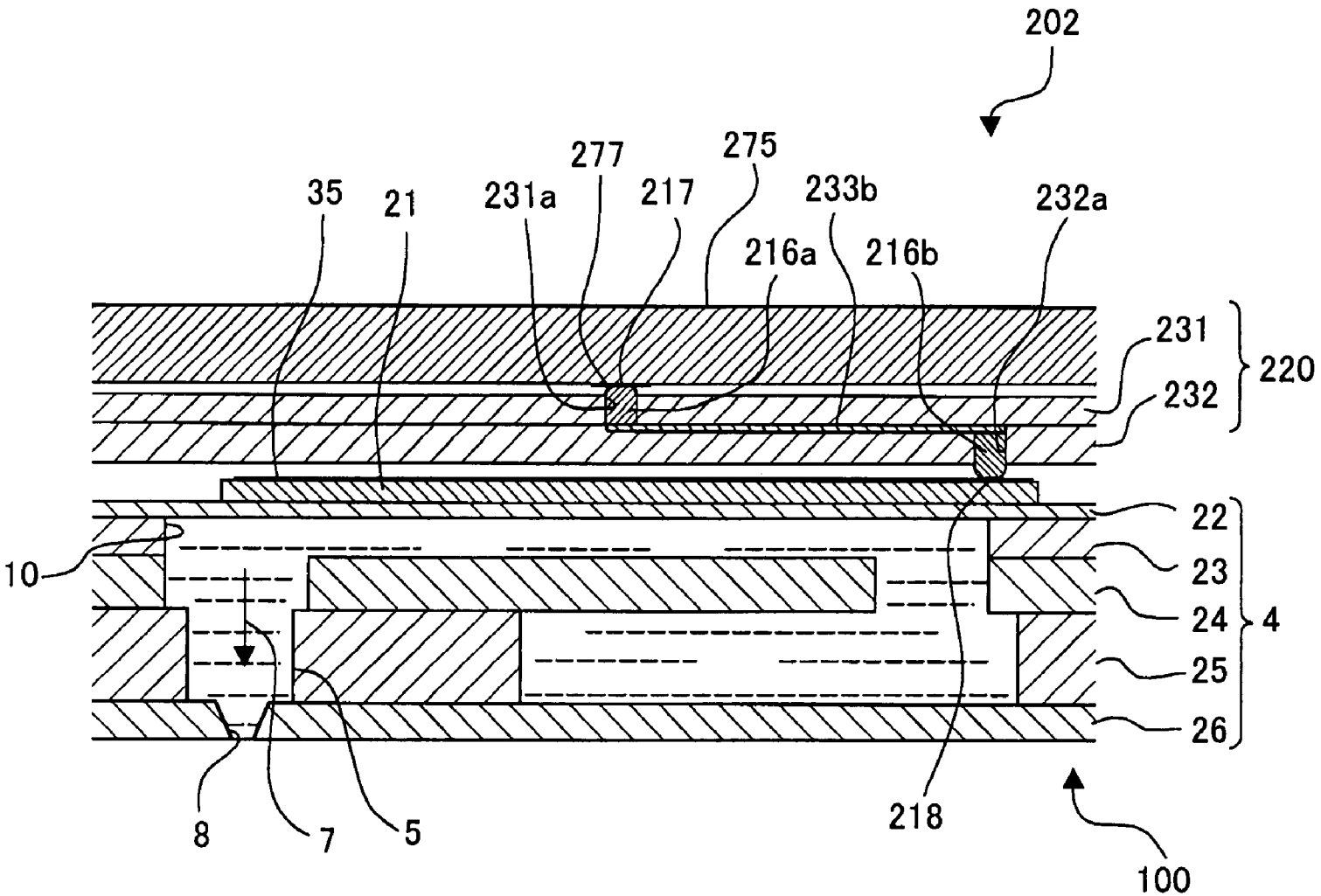
FIG. 7 is an enlarged cross section of the head unit shown in FIG. 6.
Figure 8:
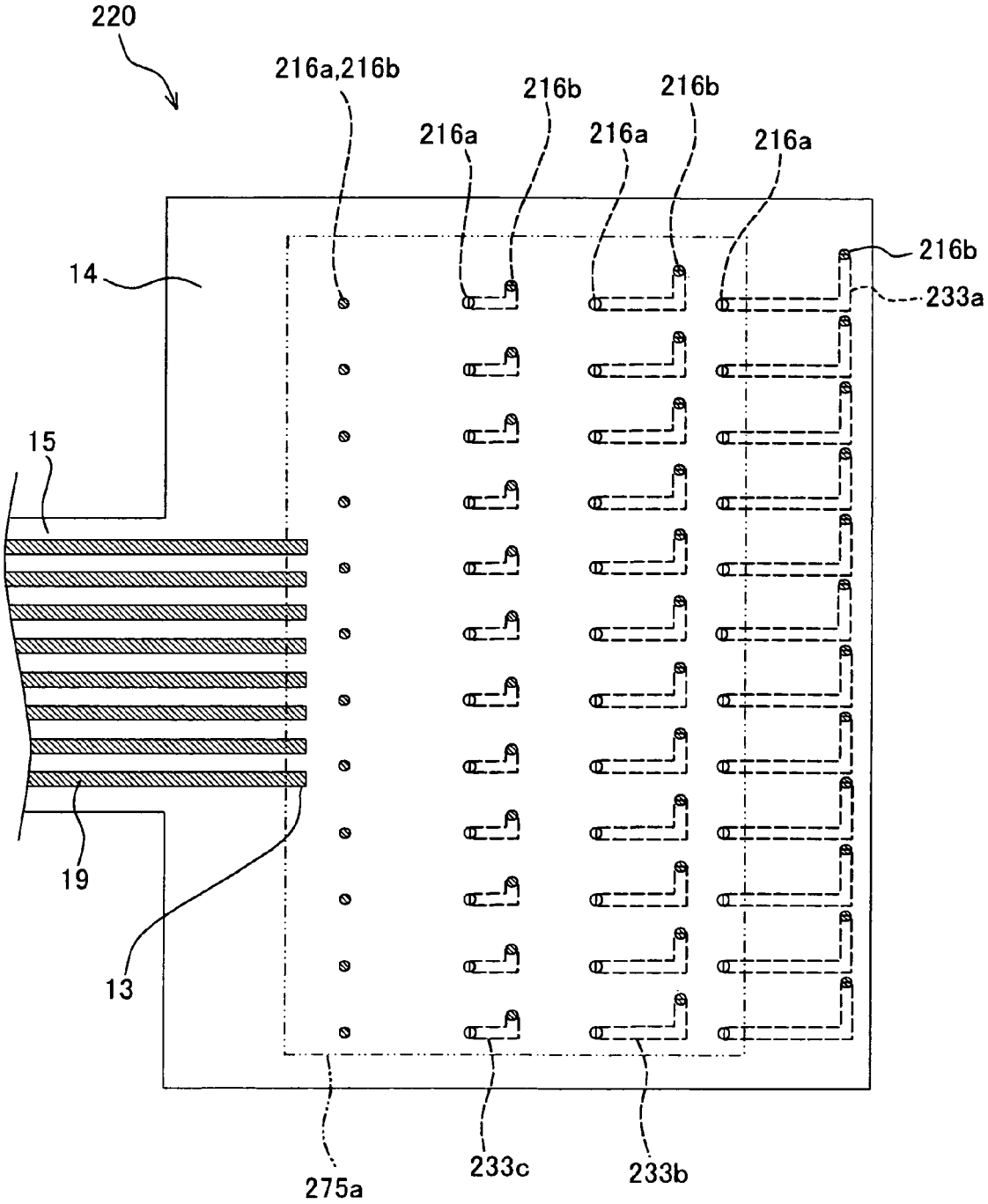
FIG. 8 is a top plan of the FPC shown in FIG. 6.

With reference to FIGS. 6 to 8, a head unit 202 according to a second embodiment of the present invention will be described below. In FIGS. 6 to 8, parts similar to the counterparts in the first embodiment are indicated with the same reference numerals as the counterparts are indicated. The similar parts will not be described.

As shown in FIG. 6, the head unit 202 is nearly identical in structure to the head unit 2 of the first embodiment, but includes a driver IC 275 and an FPC 220 that differ slightly in structure from the driver IC 75 and FPC 20, respectively. The driver IC 275 is slightly smaller in plan view than the driver IC 75. The output terminals 277 of the driver IC 275 are arranged more densely than the output terminals 77. The output terminals 277 are formed on the bottom surface of the driver IC 275 (surface of the driver IC 275 facing the FPC 220) and arranged in four parallel rows in the direction X in which the head main body 100 extends. The output terminals 277 in each row are spaced at approximately regular intervals.

As shown in FIG. 7, the FPC 220 as a signal transmission board includes an upper sheet 231 and a lower sheet 232, which are stuck together with an adhesive. The two sheets 231 and 232 are made of polyimide resin. The upper sheet 231 has a plurality of through holes 231*a* formed to cut through in a thickness direction of the upper sheet 231 in an area 275*a* indicated with the two-dot chain lines in FIG. 8. This area 275*a* extends under the driver IC 275. Each through hole 231*a* is positioned to face one of the output terminals 277 of the driver IC 275. A conductor 216*a* extends through each through hole 231*a* and protrudes from the top surface of the upper sheet 231. The protruding portion of each conductor 216*a* above the upper sheet 231 is a terminal (first terminal) 217, which is bonded to the adjacent output terminal 277 of the driver IC 275.

As shown in FIG. 7, the lower sheet 232 has a plurality of through holes 232*a* formed to cut through in the thickness direction of the sheet member 232. Each through hole 232*a* is positioned over an end portion of a separate electrode 35 that does not face the associated pressure chamber 10. A conductor 216*b* is disposed to extend through each through hole 232*a* and protrudes from the bottom surface of the lower sheet 232. The protruding portion of each conductor 216*b* below the lower sheet 232 is a terminal (second terminal) 218, which is bonded to the adjacent separate electrode 35.

As shown in FIG. 8, three types of L-shaped conductors 233*a* to 233*c* lie between the two sheets 231 and 232 of the FPC 220. The L-shaped conductors 233*a* to 233*c* are made of copper foil and electrically connect some of the conductors 216*a* and 216*b* extending through the through holes 231*a* and 232*a*, respectively. Each through hole 231*a* pairs with one of the through holes 232*a*. Specifically, each L-shaped conductor 233*a* electrically connects one of the conductors 216*b* most adjacent to the right edge of the FPC 220 in FIG. 8 and one of the conductors 216*a* second most adjacent to this edge. Likewise, each L-shaped conductor 233*b* electrically connects one of the conductors 216*b* third most adjacent to the right edge of the FPC 220 and one of the conductors 216*a* fourth most adjacent to the right edge. Likewise, each L-shaped conductor 233*c* electrically connects one of the conductors 216*b* fifth most adjacent to the right edge of the FPC 220 and one of the conductors 216*a* sixth most adjacent to this edge. Each conductor 216*a* most adjacent to the left edge of the FPC 220 is overlapped with and connected electrically to one of the conductors 216*b* most adjacent to the left edge. Thus, each of the plurality of output terminals 277 of the driver IC 275 is connected electrically to the corresponding separate electrode 35 via the FPC 220. This, as is the case with the first embodiment, enables the driver IC 275 to apply driving voltage to the piezoelectric sheets 21 in accordance with the data signals from a control unit (not shown). As is the case with the first embodiment, the voltage application drives the piezoelectric sheets 21, thereby discharging ink through the nozzles 8 of the head main body 100.

As stated above, as is the case with the first embodiment, the FPC 220 in this embodiment is interposed between the driver IC 275 and head main body 100. This prevents the heat generated by the driver IC 275 from propagating easily to the head main body 100. The through holes 231*a* of the upper sheet 231 of the FPC 220 are positioned under the respective output terminals 277 of the driver IC 275. The through holes 232*a* of the lower sheet 232 are positioned over the end portions of the respective separate electrodes 35 that do not face the respective pressure chambers 10. The L-shaped conductors 233*a* to 233*c* electrically connect some of the conductors 216*a* and 216*b* extending through the respective through holes 231*a* and 232*a*. This connection enables the driver IC 275 to be used even if the driver IC 275 is smaller in shape than the driver IC 75 of the first embodiment. Even if the driver IC 275 is an existing type having output terminals 277 in fixed positions, the L-shaped conductors 233*a* to 233*c* can connect these terminals electrically to the respective discrete electrodes 35. In this case, there is no need to produce a new driver IC 275 or a new head main body 100 so that the output terminals 277 of this driver IC are aligned with the respective conductors 216*b* for the respective separate electrodes 35.

Third Embodiment

Figure 9:
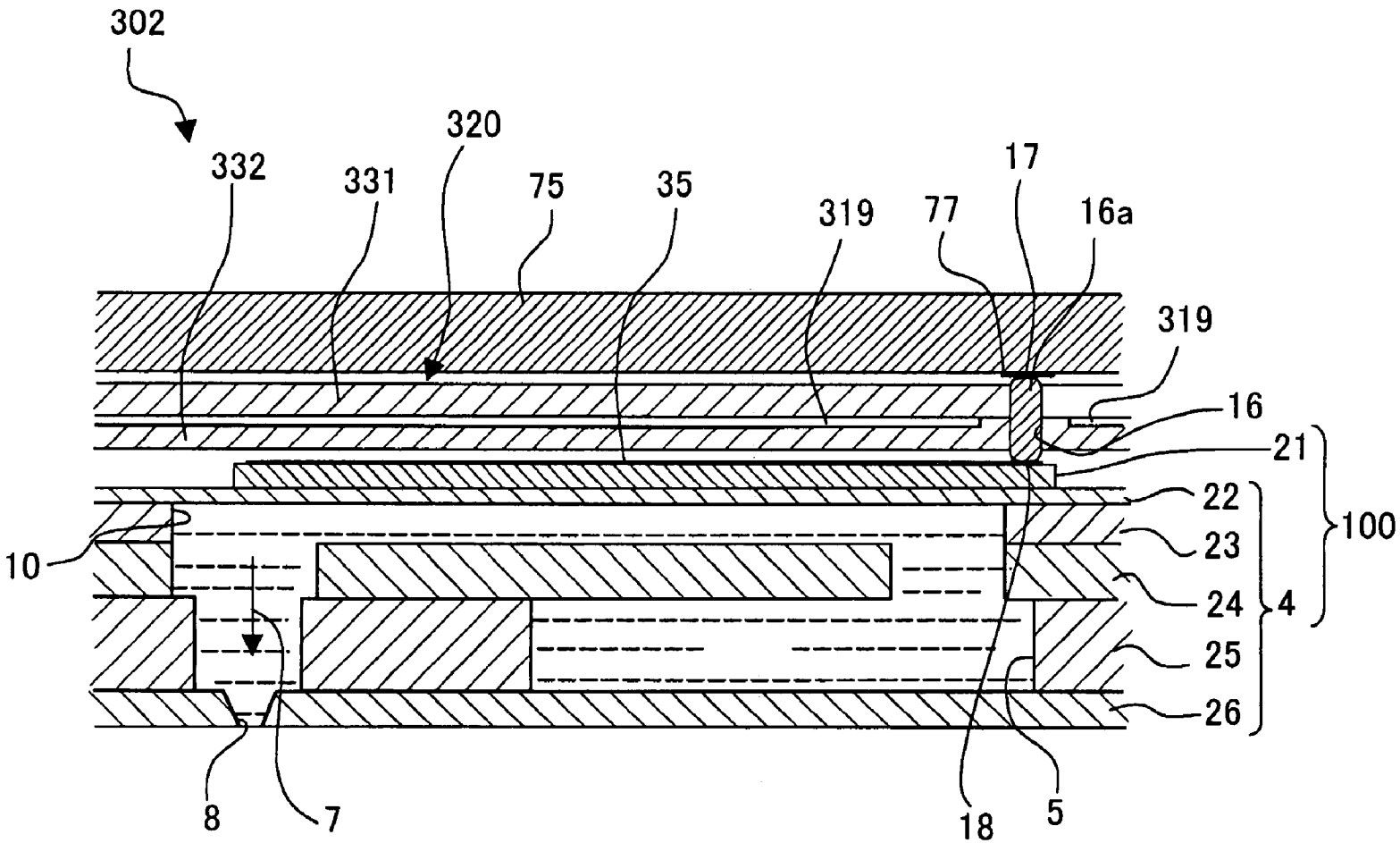
FIG. 9 is an enlarged cross section of a head unit according to a third embodiment of the present invention.
Figure 10:
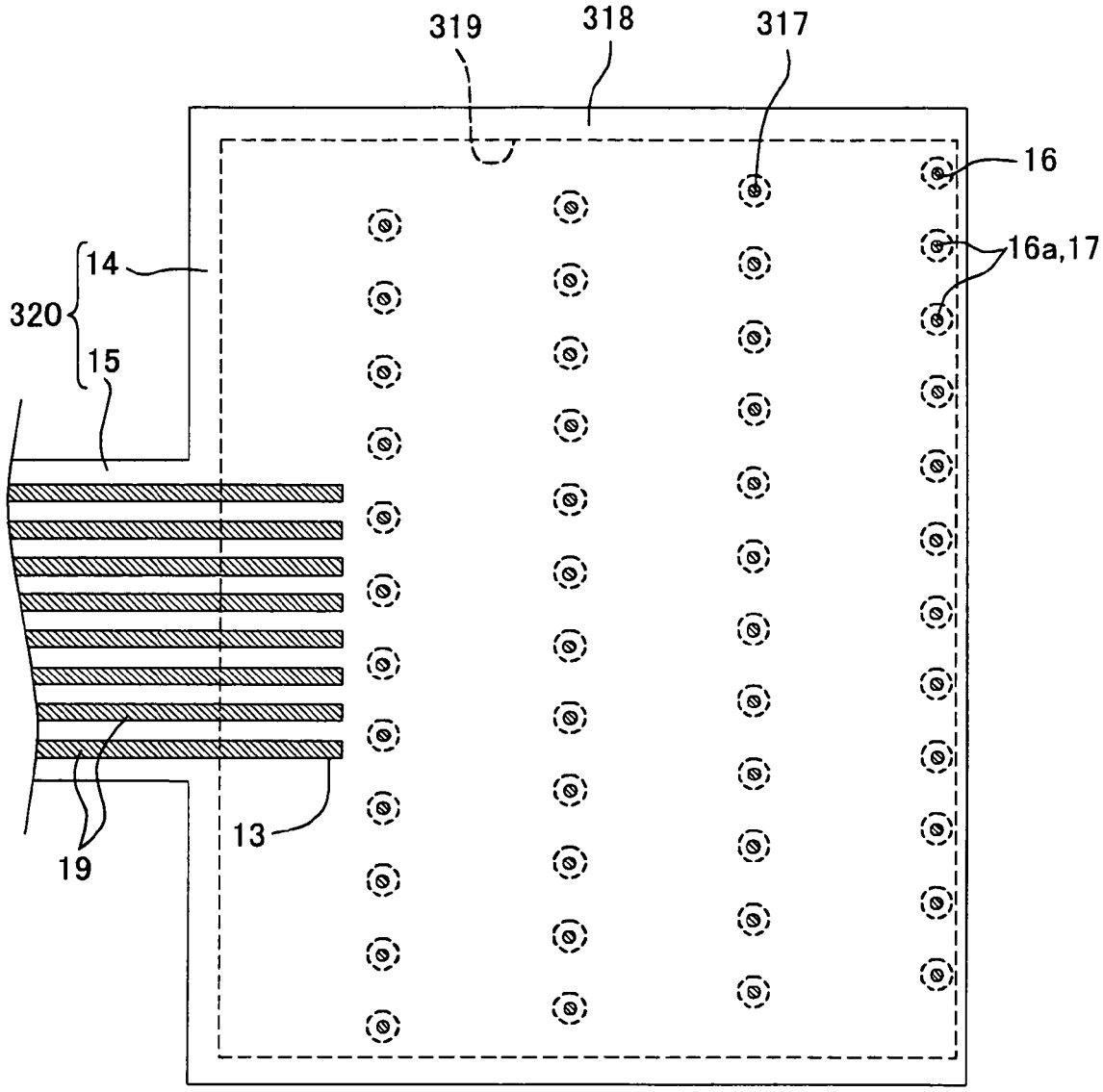
FIG. 10 is an enlarged top plan of the FPC shown in FIG. 9.

With reference to FIGS. 9 and 10, a head unit 302 according to a third embodiment of the present invention will be described below. In FIGS. 9 and 10, parts similar to the counterparts in the first and second embodiments are indicated with the same reference numerals as the counterparts are indicated. The similar parts will not be described.

As shown in FIG. 9, the head unit 302 is nearly identical in structure to the head unit 2 of the first embodiment, but includes an FPC 320 slightly different in structure from the FPC 20. The FPC 320 as a signal transmission board includes an upper sheet 331 and a lower sheet 332, which are stuck together with an adhesive. The two sheets 331 and 332 are made of the foregoing polyimide resin.

As shown in FIG. 10, the wide part 14 of the FPC 320 has a cavity or hollow 319 formed in an interior of the wide part 14 except for annular portions 317 each surrounding a through hole 16 in which a conductor 16 is arranged and peripheral portions 318 of the wide part 14. The cavity 319 is formed by a recess formed on the upper side of the lower sheet 322 by etching and, as shown in FIG. 9, covered with the upper sheet 321. The cavity 319 is lower in heat conductivity than the annular portions 317 and may be filled with a material lower in heat conductivity than polyimide resin.

As is the case with the first embodiment, the FPC 320 has a plurality of through holes 16, through each of which a conductor 16*a* extends. Thus, the FPC 320 connects the driver IC 75 electrically to the separate electrodes 35. This, as is the case with the first embodiment, enables the driver IC 75 to apply driving voltage to the piezoelectric sheets 21 in accordance with the data signals from a control unit (not shown). As is the case with the first embodiment, the voltage application drives the piezoelectric sheets 21, thereby discharging ink through the nozzles 8 of the head main body 100.

As stated above, the head unit 302 achieves effects similar to those achieved by the head unit 2 of the first embodiment. The cavity 319 formed in the FPC 320 improves the inhibition of heat propagation in comparison with the FPC 20 of the first embodiment. This more effectively prevents easy conduction of the heat generated by the driver IC 75 to the head main body 100. Because the FPC 320 includes two sheets stuck together, it is easy to produce a FPC 320 with a cavity 319 formed therein.

The preferred embodiments have been described hereinbefore. However, the present invention is not limited thereto. The embodiments may be modified into various forms within the scope defined in the claims. For example, the head units 2, 202 and 302 of the first, second and third embodiments, respectively, are applied to line type ink jet printers, but might be applied to serial type ink jet printers. The head bodies 100 of the head units 2, 202 and 302 are driven by the piezoelectric discharge pressure applying device to discharge ink through the nozzles. Alternatively, each head main body 100 may be of the bubble jet type or another type for heating the ink in pressure chambers in accordance with the signals from an FPC to apply discharge energy to the ink. The sheets as the substrates of the FPC 20, 220 and 320 may be made of non-flexible material. The FPC 20, 220 and 320 may not include conductors 19. Each of the FPC 20, 220 and 320 may be uniform in width between the associated head main body 100 and control unit.

The embodiments have been described as exemplified by ink jet head and ink jet printers provided with the ink jet heads. However, the present invention might not be limited to ink jet printers and ink jet heads, but may be applied to apparatus for discharging or ejecting medicine, a drug, an adhesive, paint or another liquid other than ink.

What is claimed is:

1. A head unit for an ink-jet printer comprising:

an ink jet head having a plurality of nozzles which discharge ink, a plurality of pressure chambers which communicate with the nozzles, respectively; and a discharge pressure applying device which applies ink discharge pressure separately to the respective pressure chambers, wherein electrodes for the pressure applying device are formed on one surface of the ink jet head;

a driver IC which is arranged to face the ink jet head and has output terminals formed on a predetermined surface facing the one surface of the ink jet head;

an insulator which is interposed between the ink jet head and the driver IC and through which through holes are formed; and first signal lines each of which extends through one of the through holes and connects one of the output terminals of the driver IC electrically to one of the electrodes of the pressure applying device.

2. The head unit according to claim 1, wherein the insulator has a first surface and a second surface, the first and second surfaces facing the driver IC and the ink jet head, respectively, the head unit further comprising first terminals which are formed on the first surface of the insulator and each of which is bonded to one of the output terminals of the driver IC, and second terminals which are formed on the second surface of the insulator and each of which is bonded to one of the electrodes of the pressure applying device; wherein each of the first signal lines connects the associated first and second terminals electrically together.

3. The head unit according to claim 2, wherein the driver IC further has an input terminal formed on the predetermined surface, the head unit further comprising a third terminal formed on the first surface of the insulator and bonded to the input terminal of the driver IC; and a second signal line formed along an extending direction of the insulator and connected electrically to the third terminal.

4. The head unit according to claim 3, wherein the insulator includes:

a wide part which is interposed between the ink jet head and the driver IC, is larger in outer shape than the driver IC, and formed with the first signal lines and the third terminal; and a narrow part formed with the second signal line.

5. The head unit according to claim 4, wherein the wide part is formed to be smaller in outer shape than the first surface of the ink jet head.

6. The head unit according to claim 4, wherein the wide part of the insulator includes:

first regions each of which is disposed in the vicinity of one of the first signal lines; and a second region lower in heat conductivity than the first regions.

7. The head unit according to claim 6, wherein the insulator includes:

a first insulating sheet having a surface facing the driver IC; and a second insulating sheet having a surface facing the ink jet head, wherein the first and second insulating sheets are adhered together.

8. The head unit according to claim 1, wherein one opening and the other opening of each of the through holes are formed in positions different from each other in an extending plane of the insulator.

9. The head unit according to claim 1, wherein the insulator is formed of a resin.

10. An ink-jet printer comprising:

an ink jet head having a plurality of nozzles which discharge ink, a plurality of pressure chambers which communicate with the nozzles, respectively, and a discharge pressure applying device which applies ink discharge pressure separately to the respective pressure chambers, wherein electrodes for the pressure applying device are formed on one surface of the ink jet head;

a driver IC having an input terminal and output terminals both of which are formed on a predetermined surface facing the one surface of the ink jet head, wherein a data signal corresponding to an image from the input terminal is inputted to the driver IC and the driver IC outputs a driving signal from one of the output terminals to the pressure applying device;

a signal transmission board which transmits the data signal to the driver IC and which transmits the driving signal outputted from the driver IC to the ink jet head;

wherein the signal transmission board includes a substrate which is formed of a insulating material and is interposed partially between the ink jet head and the driver IC, first signal lines which transmit the driving signal to the ink jet head, and a second signal line which transmits the data signal to the driver IC;

wherein the first signal lines are embedded in through holes which are formed through the substrate, and electrically connect first terminals, each of which is formed on a surface of the substrate facing the driver IC and connected to one of the output terminals of the driver IC, and second terminals each of which is formed on a surface of the substrate facing the ink jet head and is bonded to one of the electrodes of the pressure applying device; and wherein the second signal line is formed along an extending direction of the substrate and is electrically connected to a third terminal which is formed on the surface of the substrate facing the driver IC.

11. A signal transmission board which is used for an ink-jet printer having a plurality of nozzles which discharge ink, a plurality of pressure chambers which communicate with the nozzles, respectively, and a discharge pressure applying device which applies ink discharge pressure separately to the respective pressure chambers, wherein electrodes for the pressure applying device are formed on one surface of the ink jet head; and a driver IC having an input terminal and output terminals both of which are formed on a predetermined surface facing the one surface of the ink jet head, wherein a data signal corresponding to an image from the input terminal is inputted to the driver IC and the driver IC outputs a driving signal from one of the output terminals to the pressure applying device, the signal transmission board comprising:

a substrate which is formed of a insulating material and is interposed partially between the ink jet head and the driver IC;

first signal lines which transmit the driving signal to the ink jet head; and a second signal line which transmits the data signal to the driver IC;

wherein the first signal lines are embedded in through holes formed through the substrate, respectively, and electrically connect first terminals each of which is formed on a surface of the substrate facing the driver IC and bonded to one of the output terminals of the driver IC, and second terminals each of which is formed on a surface of the substrate facing the ink jet head and is bonded to one of the electrodes of the pressure applying device; and wherein the second signal line is formed along an extending direction of the substrate and is electrically connected to a third terminal which is formed on the surface of the substrate facing the driver IC.

12. The signal transmission board according to claim 11, wherein one opening and the other opening of each of the through holes are formed in positions different from each other in an extending plane of the substrate.

13. A head unit for a liquid discharging apparatus, comprising:

a liquid discharging head having a plurality of nozzles which discharge liquid, a plurality of pressure chambers which communicate with the nozzles, respectively, and an actuator which applies liquid discharge pressure separately to the respective pressure chambers;

a driver IC which drives the actuator; and an insulating sheet which includes wiring connected to the driving IC to transmit a data signal to the driver IC through the wiring, wherein the insulating sheet is interposed between the actuator and the driver IC, wherein the head unit has a first surface and a second surface opposite to the first surface, the nozzles are formed on the second surface, the head unit further has electrodes for the actuator which are formed on the first surface of the head unit, and wherein the head unit includes conductors extending through the insulating sheet, wherein each of the conductors connects the driver IC and one of the electrodes for the actuator electrically together.

14. The head unit according to claim 13, wherein the driver IC is mounted on the insulating sheet to form a flexible printed circuit.

15. The head unit according to claim 13, wherein the insulating sheet includes:

a wide part supporting the driver IC thereon and being larger in area than the driver IC; and a narrow part extending from the wide part.

16. The head unit according to claim 13, wherein the insulating sheet is formed of polyimide resin.

17. A liquid discharging apparatus including a head unit as defined in claim 13.

* * * * *